US010602887B2

(12) United States Patent
Troutman et al.

(10) Patent No.: US 10,602,887 B2
(45) **Date of Patent: *Mar. 31, 2020**

(54) TOWEL DISPENSERS

(71) Applicant: GPCP IP HOLDINGS LLC, Atlanta, GA (US)

(72) Inventors: William Bryant Troutman, Charlotte, NC (US); William Bryant Troutman, II, Charlotte, NC (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/504,366

(22) Filed: Jul. 8, 2019

(65) Prior Publication Data

US 2019/0328184 A1 Oct. 31, 2019

Related U.S. Application Data

(63) Continuation of application No. 16/036,244, filed on Jul. 16, 2018, now Pat. No. 10,342,394, which is a (Continued)

(51) Int. Cl.

| | |
|---|---|
| ***A47K 10/34*** | (2006.01) |
| ***A47K 10/36*** | (2006.01) |
| ***A47K 10/32*** | (2006.01) |

(52) U.S. Cl.

CPC ..... *A47K 10/34* (2013.01); *A47K 10/36* (2013.01); *A47K 10/3612* (2013.01);

(Continued)

(58) Field of Classification Search

CPC .... A47K 10/34; A47K 10/36; A47K 10/3612; A47K 2010/3681; A47K 2010/3233; A47K 2010/3668; Y10T 225/10; Y10T 225/226

See application file for complete search history.

(56) References Cited

U.S. PATENT DOCUMENTS

| | | | |
|---|---|---|---|
| 1,761,464 | A | 6/1930 | Caps |
| 2,135,767 | A | 11/1938 | Price et al. |

(Continued)

FOREIGN PATENT DOCUMENTS

| | | | |
|---|---|---|---|
| CN | 209712725 | U | 12/2019 |
| EP | 0573558 | B1 | 12/1997 |

(Continued)

OTHER PUBLICATIONS

International Search Report and Written Opinion of the International Search Authority (Korean Intellectual Property Office) for International Patent Application Serial No. PCT/US2010/037561, dated Jan. 10, 2011.

(Continued)

*Primary Examiner* — William A. Rivera

(74) *Attorney, Agent, or Firm* — Nelson Mullins Riley & Scarborough LLP

(57) ABSTRACT

A towel dispenser includes a housing mounted to a wall and defining an interior space for receiving toweling comprising a roll of towels, the interior space comprising a curved surface configured to receive the roll of towels in floating engagement therewith such that the roll of towels rolls and slides on the curved surface during unwinding of the roll of towels. The towel dispenser further includes a loading door configured to rotate relative to the main body, when the main body is mounted to a wall, between a closed position in which the loading door extends over a top of and closes off the interior space of the main body in which toweling is received, and an open position, in which the housing is configured to receive toweling therein without obstruction by the loading door, with the loading door extending upwardly above and over a top of the housing.

20 Claims, 4 Drawing Sheets

Related U.S. Application Data continuation of application No. 15/462,819, filed on Mar. 18, 2017, now abandoned, which is a continuation of application No. 14/468,931, filed on Aug. 26, 2014, now Pat. No. 9,596,964, which is a continuation-in-part of application No. 14/468,313, filed on Aug. 25, 2014, now Pat. No. 9,474,422.

(60) Provisional application No. 61/920,772, filed on Dec. 25, 2013, provisional application No. 61/869,648, filed on Aug. 23, 2013.

(52) U.S. Cl.
CPC ..... *A47K 2010/3233* (2013.01); *A47K 2010/3668* (2013.01); *A47K 2010/3681* (2013.01)

(56) References Cited

U.S. PATENT DOCUMENTS 2,193,759 A 3/1940 Birr
RE22,565 E 11/1944 Gillanders et al.
2,487,763 A 11/1949 Patterson et al.
3,575,328 A 4/1971 Jespersen et al.
3,730,409 A 5/1973 Ratti
RE28,911 E 7/1976 Jespersen et al.
4,131,044 A 12/1978 Cassia
4,137,805 A 2/1979 DeLuca et al.
4,142,431 A 3/1979 Jespersen
4,188,844 A 2/1980 DeLuca
4,191,307 A 3/1980 LeClaire, Jr. et al.
4,203,562 A 5/1980 DeLuca et al.
4,206,858 A 6/1980 DeLuca et al.
4,236,679 A 12/1980 Jespersen
4,286,489 A 9/1981 DeLuca
4,307,638 A 12/1981 DeLuca et al.
4,307,639 A 12/1981 DeLuca
4,340,195 A 7/1982 DeLuca
4,404,880 A 9/1983 DeLuca
4,611,768 A 9/1986 Voss et al.
4,666,099 A 5/1987 Hoffman et al.
4,738,176 A 4/1988 Cassia
4,817,483 A 4/1989 Armbruster
4,848,690 A 7/1989 Lemoine
4,856,724 A 8/1989 Jespersen
4,944,466 A 7/1990 Jespersen
D312,369 S 11/1990 DeLuca et al.
4,984,530 A 1/1991 Dutton
D316,788 S 5/1991 Fischer et al.
5,020,403 A 6/1991 D'Angelo et al.
5,048,386 A 9/1991 DeLuca et al.
5,078,033 A 1/1992 Formon
5,107,734 A 4/1992 Armbruster
5,137,173 A 8/1992 Hughes et al.
5,249,755 A 10/1993 Jespersen
5,271,574 A 12/1993 Formon et al.
5,288,032 A 2/1994 Boone et al.
5,294,192 A 3/1994 Omdoll et al.
5,305,937 A 4/1994 Barnett
5,314,131 A 5/1994 McCanless et al.
5,375,785 A 12/1994 Boone et al.
5,441,189 A 8/1995 Formon et al.
5,452,832 A 9/1995 Niada
5,526,973 A 6/1996 Boone et al.
5,558,302 A 9/1996 Jesperson
5,601,253 A 2/1997 Formon et al.
5,765,717 A 6/1998 Gottselig
5,772,291 A 6/1998 Byrd et al.
5,924,617 A 7/1999 LaCount et al.
5,979,821 A 11/1999 LaCount et al.
5,979,822 A 11/1999 Morand et al.
D419,014 S 1/2000 Fluegge et al.
D419,805 S 2/2000 Fluegge et al.
6,032,898 A 3/2000 LaCount et al.
6,105,898 A 8/2000 Byrd et al.
6,152,397 A 11/2000 Purcell
6,161,796 A 12/2000 Daniels
6,237,871 B1 5/2001 Morand et al.
6,250,530 B1 6/2001 LaCount et al.
6,354,533 B1 3/2002 Jespersen
6,412,679 B2 7/2002 Formon et al.
6,419,136 B2 7/2002 Formon et al.
6,554,158 B2 4/2003 Kapiloff et al.
6,607,160 B2 8/2003 Lewis et al.
6,695,246 B1 2/2004 Elliot et al.
6,710,606 B2 3/2004 Morris
6,736,348 B1 5/2004 Formon et al.
6,736,466 B1 5/2004 Helland et al.
6,742,689 B2 6/2004 Formon et al.
6,745,927 B2 6/2004 Formon et al.
6,758,434 B2 7/2004 Kapiloff et al.
6,766,977 B2 7/2004 Denen et al.
6,826,985 B2 12/2004 Broehl
6,826,991 B1 12/2004 Rasmussen
6,830,210 B2 12/2004 Formon et al.
6,854,684 B2 2/2005 Byrd et al.
6,871,815 B2 3/2005 Moody et al.
6,902,134 B2 6/2005 Green et al.
6,903,654 B2 6/2005 Hansen et al.
6,929,213 B1 8/2005 Contreras
6,952,067 B2 10/2005 Tanaka et al.
6,959,891 B2 11/2005 Kapiloff et al.
6,964,395 B1 11/2005 Lewis et al.
6,988,689 B2 1/2006 Thomas et al.
6,994,408 B1 2/2006 Bunnell
7,017,856 B2 3/2006 Moody et al.
7,040,566 B1 5/2006 Rodrian et al.
7,040,567 B1 5/2006 Lewis et al.
D522,781 S 6/2006 Wieser et al.
7,114,677 B2 10/2006 Formon et al.
7,168,602 B2 1/2007 Broehl
7,182,289 B2 2/2007 Moody et al.
7,185,841 B2 3/2007 Kaufmann
7,185,842 B2 3/2007 Lewis et al.
7,191,977 B2 3/2007 Denen et al.
7,219,852 B2 5/2007 Tramontina et al.
7,237,744 B2 7/2007 Morris et al.
D550,999 S 9/2007 Formon et al.
7,296,765 B2 11/2007 Rodrian
D564,269 S 3/2008 Paal et al.
7,338,008 B1 3/2008 Jenkins
7,341,170 B2 3/2008 Boone
7,347,134 B2 3/2008 Lewis et al.
7,387,274 B2 6/2008 Moody et al.
7,406,901 B2 8/2008 Schmidt et al.
7,438,256 B2 10/2008 Nip et al.
7,530,524 B2 5/2009 Wieser et al.
7,533,845 B2 5/2009 Neveu et al.
7,553,098 B2 6/2009 Maekawa et al.
7,568,652 B2 8/2009 Cittadino et al.
7,594,622 B2 9/2009 Witt et al.
7,624,664 B2 12/2009 Morris et al.
7,698,980 B2 4/2010 Morris
7,774,096 B2 8/2010 Goerg et al.
7,783,380 B2 8/2010 York et al.
7,821,155 B2 10/2010 Reinsel et al.
7,832,679 B2 11/2010 Denen et al.
7,845,593 B2 12/2010 Formon et al.
7,878,446 B2 2/2011 Reinsel et al.
7,887,005 B2 2/2011 Troutman et al.
7,946,522 B2 5/2011 Lewis et al.
7,963,475 B2 6/2011 Rodrian
8,079,540 B2 12/2011 Troutman et al.
8,079,541 B2 12/2011 Troutman et al.
8,079,542 B2 12/2011 Troutman et al.
8,079,543 B2 12/2011 Troutman et al.
8,083,170 B2 12/2011 Troutman et al.
8,186,551 B2 5/2012 Morris
8,231,075 B2 7/2012 Troutman et al.
8,231,076 B2 7/2012 Troutman et al.
8,240,594 B2 8/2012 Troutman et al.
8,336,803 B2 12/2012 Troutman et al.
8,434,709 B2 5/2013 Troutman et al.

(56) References Cited

U.S. PATENT DOCUMENTS

| | | | | |
|---|---|---|---|---|
| 8,464,976 | B2 | 6/2013 | Mok et al. | |
| 8,561,933 | B2 | 10/2013 | Troutman et al. | |
| 8,632,030 | B2 | 1/2014 | Troutman et al. | |
| 9,144,352 | B2 | 9/2015 | Cittadino et al. | |
| 9,282,855 | B2 | 3/2016 | Troutman et al. | |
| 9,307,875 | B2 | 4/2016 | Clarkin | |
| 9,474,422 | B1 | 10/2016 | Troutman et al. | |
| 9,480,370 | B2 | 11/2016 | Troutman et al. | |
| 9,596,964 | B1 | 3/2017 | Troutman et al. | |
| 9,642,503 | B1 | 5/2017 | Troutman et al. | |
| D807,663 | S | 1/2018 | Taylor | |
| 10,165,907 | B1 | 1/2019 | Troutman et al. | |
| 10,342,394 | B2 * | 7/2019 | Troutman | A47K 10/34 |
| 2001/0001475 | A1 | 5/2001 | Formon et al. | |
| 2003/0019971 | A1 | 1/2003 | Lewis et al. | |
| 2003/0168550 | A1 | 9/2003 | Formon et al. | |
| 2004/0251375 | A1 | 12/2004 | Denen et al. | |
| 2005/0150992 | A1 | 7/2005 | Morris et al. | |
| 2005/0171634 | A1 | 8/2005 | York et al. | |
| 2006/0006275 | A1 | 1/2006 | Neveu et al. | |
| 2006/0138274 | A1 | 6/2006 | Goeking et al. | |
| 2006/0169827 | A1 | 8/2006 | Lewis et al. | |
| 2006/0173576 | A1 | 8/2006 | Goerg et al. | |
| 2007/0080255 | A1 | 4/2007 | Witt et al. | |
| 2007/0152010 | A1 | 7/2007 | Denen et al. | |
| 2007/0158359 | A1 | 7/2007 | Rodrian | |
| 2007/0194166 | A1 | 8/2007 | Reinsel et al. | |
| 2008/0011772 | A1 | 1/2008 | Morris et al. | |
| 2008/0018302 | A1 | 1/2008 | Reinsel et al. | |
| 2008/0078777 | A1 | 4/2008 | Cittadino et al. | |
| 2008/0087758 | A1 | 4/2008 | Formon et al. | |
| 2008/0099595 | A1 | 5/2008 | Lewis et al. | |
| 2009/0065626 | A1 | 3/2009 | Petri et al. | |
| 2009/0065628 | A1 | 3/2009 | Troutman et al. | |
| 2010/0219280 | A1 | 9/2010 | Troutman et al. | |
| 2010/0219281 | A1 | 9/2010 | Troutman et al. | |
| 2010/0219282 | A1 | 9/2010 | Troutman et al. | |
| 2010/0219283 | A1 | 9/2010 | Troutman et al. | |
| 2010/0219284 | A1 | 9/2010 | Troutman et al. | |
| 2010/0314429 | A1 | 12/2010 | Troutman et al. | |
| 2011/0068209 | A1 | 3/2011 | Troutman et al. | |
| 2011/0068210 | A1 | 3/2011 | Troutman et al. | |
| 2011/0068211 | A1 | 3/2011 | Troutman et al. | |
| 2011/0068212 | A1 | 3/2011 | Troutman et al. | |
| 2011/0068213 | A1 | 3/2011 | Troutman et al. | |
| 2011/0068214 | A1 | 3/2011 | Troutman et al. | |
| 2011/0068215 | A1 | 3/2011 | Troutman et al. | |
| 2011/0068216 | A1 | 3/2011 | Troutman et al. | |
| 2011/0068217 | A1 | 3/2011 | Troutman et al. | |
| 2011/0068218 | A1 | 3/2011 | Troutman et al. | |
| 2011/0068219 | A1 | 3/2011 | Troutman et al. | |
| 2012/0104141 | A1 | 5/2012 | Troutman et al. | |
| 2012/0305696 | A1 | 12/2012 | Troutman et al. | |
| 2014/0021286 | A1 | 1/2014 | Troutman et al. | |
| 2014/0021287 | A1 | 1/2014 | Troutman et al. | |
| 2014/0131506 | A1 | 5/2014 | Clarkin | |
| 2016/0287036 | A1 | 10/2016 | Troutman et al. | |
| 2017/0042393 | A1 | 2/2017 | Troutman et al. | |
| 2020/0037829 | A1 | 2/2020 | Troutman et al. | |

FOREIGN PATENT DOCUMENTS

| | | | |
|---|---|---|---|
| JP | H05-111442 | A | 5/1993 |
| JP | 2007-014367 | A | 1/2007 |
| WO | WO 1998/053728 | A1 | 12/1998 |
| WO | WO 2010/141931 | A3 | 3/2011 |

OTHER PUBLICATIONS

Innovia WB2-159S Automatic Paper Towel Dispenser, retrieved Feb. 1, 2018 from <https://www.amazon.com/gp/product/B008HDREZ6/ref=s9_acsd_hps_bw_cr_x_a_w>.

* cited by examiner

TOWEL DISPENSERS

CROSS-REFERENCE TO RELATED APPLICATION

This application claims priority to and is a continuation of U.S. patent application Ser. No. 16/036,244, entitled "Towel Dispensers" filed Jul. 16, 2018, which is a continuation of U.S. patent application Ser. No. 15/462,819, entitled "Wall Mounted Towel Dispensers" filed Mar. 18, 2017, which is a continuation of U.S. patent application Ser. No. 14/468,931, entitled "Wall Mounted Towel Dispensers" filed Aug. 26, 2014, issued on Mar. 21, 2017 as U.S. Pat. No. 9,596,964, which is a continuation-in-part of U.S. patent application Ser. No. 14/468,313, entitled "Wall Mounted Towel Dispenser" filed Aug. 25, 2014, issued on Oct. 25, 2016 as U.S. Pat. No. 9,474,422, which claims benefit of U.S. Provisional Application No. 61/920,772, entitled "Wall Mounted Towel Dispensers" filed Dec. 25, 2013, and of U.S. Provisional Application No. 61/869,648, entitled "Wall Mounted Towel Dispenser" filed Aug. 23, 2013, the contents of each being incorporated by reference hereby in their entirety.

INCORPORATION BY REFERENCE

The present application hereby incorporates by reference U.S. Patent Application Publication Nos. 2009/0065626; 2010/0219280; 2010/0219281; 2010/0219282; 2010/0219283; 2010/0219284; 2010/0314429; 2011/0068209; 2011/0068210 2011/0068211; 2011/0068212; 2011/0068213; 2011/0068214; 2011/0068215; 2011/0068216; 2011/0068217; 2011/0068218; 2011/0068219; 2012/0104141; 2012/0305696.

Furthermore, the present application hereby incorporates by reference the disclosure of the Appendix attached hereto, including any and all exhibits contained therein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to towel dispensers and, more particularly, to towel dispensers in which a length of toweling is extended from the housing for grasping and pulling by a user for separation and dispensing of one or more towels. In preferred embodiments of the invention, the toweling comprises a roll of perforated towels, in which the towels are connected together and separable at perforation formed between the towels.

Towel dispensers are well known and generally include a housing configured to receive toweling; a guide system that defines a path within the housing and that guides the toweling along the path during movement of the toweling while towels are dispensed; and a motor that moves the toweling along the path to the exterior of the housing, thereby exteriorly extending the toweling from the housing. The guide system can include rollers or fixed guides and typically includes one or more driven rollers connected to the motor by a transmission. A switch or sensor for detecting motion or proximity of an object—such as a hand—is provided to initiate the operation of the motor. For example, in a known dispenser, a controller is electrically connected to the sensor and is configured to activate the motor when the sensor generates a signal that indicates the presence of the wave of a hand.

Conventional towel dispensers generally operate as follows. A roll of toweling is placed within the housing and threaded through the guide system. A user causes a towel to be dispensed by placing a hand or other object near the sensor. Alternatively, the dispensing of toweling can be initiated by pressing a button or switch that is configured to activate the motor. Dispensing of the toweling is stopped when a predetermined length of toweling has been dispensed. Alternatively, in some cases the toweling is stopped when the hand is removed or button/switch is released.

Conventional towel dispensers are disclosed in each of U.S. Pat. Nos. 6,412,679; 6,419,136; 6,742,689; 6,745,927; 6,766,977; and 7,191,977. Each of these U.S. patents is incorporated herein by reference.

Even in view of known towel dispensers, it is believed that one or more needs exist for advancements in towel dispensers.

SUMMARY OF THE INVENTION

The present invention includes many aspects and features. Moreover, while many aspects and features relate to, and are described in, the context of toweling including a roll of sheet material separated by perforations that define towels when separated, the present invention is not limited to use only in such context, and may be used with toweling that does not include such perforations. Moreover, while preferred implementations relate to dispensing of paper towels, the invention is not limited to such implementations and is applicable, for example, in implementations relating to the dispensing of other types of toweling, including toilet paper.

Accordingly, in an aspect of the invention, a towel dispenser, comprises a housing and a loading door, wherein the loading door, when in a closed position, extends over a top of and closes off an interior space of a main body of the housing in which the toweling is received. Preferably, the toweling is receive by being lowered or dropped into the interior space of the main body.

In a feature, the main body includes a back wall configured for mounting of the housing to a wall of a room.

In additional features, the housing includes one or more rollers extending along a front area of the main body proximate an edge of the interior space, and the housing includes a motor assembly for driving the one or more rollers.

In a feature, the toweling comprises a roll of towels.

In a feature, the interior space comprises a curved surface that receives the roll of towels in floating engagement therewith such that the roll of towels rolls and slides on the curved surface during unwinding of the roll of towels.

In a feature, the loading door includes one or more rollers. The rollers may extend along a section of the interior side of the loading door.

In a feature, the loading door is configured to rotate relative to the main body, when the main body is mounted to a wall, between the closed position and an open position. When in the open position, the housing is configured to receive toweling therein without obstruction by the loading door. When in the closed position, and when the loading door and the housing include rollers, the loading door and housing are configured to receive an extent of toweling between the loading door and the housing such that the extent of toweling is extended from the housing by driving of the rollers of the housing and loading door. Preferably, the one or more rollers of the loading door are driven by rotation of the one or more rollers of the housing when the one or more rollers of the housing are driven by the motor assembly. A transmission may be used to drive the one or more rollers of the housing, with the rollers of the door being indirectly driven thereby.

In an additional feature, an opening is defined by the housing through which the toweling is inserted into the interior space of the main body when the loading door is in the open position, the opening extending across a top of the main body and further extending down a forward side of the main body so as to expose approximately half of an exterior curved surface area of a roll of towels when received in the interior space with the loading door in the open position, the loading door further extending downwardly and covering the opening along the forward side of the main body when the loading door is in the closed position.

In another feature, the loading door is at least partially transparent. When transparent, the toweling within the interior space of the main body preferably is visible when the loading door is in the closed position.

Moreover, when the loading door includes rollers and is transparent, the section of the loading door along which the rollers extend preferably is not transparent. Such section preferably is located proximate an end of the loading door distal to a pivot axis of one or more hinges of the loading door by which the loading door moves between the open and closed positions.

In a feature, the dispenser further includes one or more sensors mounted to the main body and operatively connected to the motor assembly (or controller thereof). Each sensor is configured to sense a leading edge of the toweling between a gap formed by the main body and the loading door when the loading door is in the closed position.

In a feature, the dispenser further includes a sensor operatively connected to the motor assembly (or controller thereof) and located on an exterior surface of the main body for detecting the presence of an object or movement. The sense preferably causes the motor assembly to drive the rollers when a hand wave is detected by such sensor.

In a feature, the dispenser further includes a light indicator for indicating a status of the towel dispenser. The light indicator preferably comprises an LED for indicating a status of the towel dispenser.

In a feature, the dispenser further includes toweling received within the interior space of the main body. The toweling preferably comprises a perforated roll of towels and, in particular, a roll of perforated paper towels.

In another aspect, a wall mounted towel dispenser mounted for dispensing toweling includes a housing, comprising: (i) a main body having a back wall by which the dispenser is mounted to a wall of a room and which main body defines an interior space in which toweling comprising a roll of towels is received; (ii) one or more rollers extending along a front area of the main body proximate an edge of the interior space; and (iii) a motor assembly for driving the one or more rollers. The interior space of the main body comprises a curved surface configured to receive the roll of towels in floating engagement therewith such that the roll of towels rolls and slides on the curved surface during unwinding of the roll of towels.

Additionally, the dispenser comprises a loading door having one or more rollers extending along a section of the interior side of the loading door, the loading door being configured to rotate relative to the main body, between, (i) a closed position, in which the one or more rollers of the loading door are driven by rotation of the one or more rollers of the housing when the one or more rollers of the housing are driven by the motor assembly, the loading door and the housing being configured to receive an extent of toweling between the loading door and the housing when the loading door is in the closed position such that the extent of toweling is extended from the housing by driving of the rollers of the housing and loading door, and (ii) an open position, in which the housing is configured to receive toweling therein. The loading door when in the closed position extends over a top of and closes off the interior space of the main body in which toweling is received.

In a feature, an opening is defined by the housing through which the toweling is inserted into the interior space of the main body when the loading door is in the open position, the opening extending across a top of the main body and down a forward side of the main body so as to expose approximately half of an exterior curved surface area of a roll of towels when received in the interior space with the loading door in the open position, the loading door further extending downwardly and covering the opening along the forward side of the main body when the loading door is in the closed position.

In another feature, the loading door is transparent except along the section of one or more rollers of the loading door, whereby the toweling within the interior space of the main body is visible when the loading door is in the closed position.

In another aspect, a towel dispenser includes a housing configured to be mounted to a wall along a back thereof, and defining an interior space for receiving toweling comprising a roll of towels, the interior space comprising a curved surface configured to receive the roll of towels in floating engagement therewith such that the roll of towels rolls and slides on the curved surface during unwinding of the roll of towels. The towel dispenser further includes a loading door having one or more rollers extending along a section of the interior side of the loading door, the loading door being configured to rotate relative to the main body, when the main body is mounted to a wall, between, (i) a closed position, in which the loading door and the housing are configured to receive an extent of toweling therebetween for dispensing of the toweling, and in which the loading door extends over a top of and closes off the interior space of the main body in which toweling is received, and (ii) an open position, in which the housing is configured to receive toweling therein without obstruction by the loading door, with the loading door extending upwardly above and over a top of the housing.

In a feature, the towel dispenser is configured to receive toweling therein for dispensing by moving the loading door to the open position, placing the a roll of towels down through a top opening into the interior space of the housing, causing an extent of the toweling to extend over an edge of the housing proximate the interior space such that the extent of toweling is positioned between the loading door and the main body when the loading door is moved into the closed position, and moving the loading door into the closed position.

The towel dispenser preferably is further configured such that no further threading or positioning of the toweling is required to load the toweling for dispensing. Preferably, the toweling is not mounted on a spool when within the interior space during unwinding, and the toweling is not fixed relative to an axis of the housing during unwinding.

Still yet other aspects and features of the invention are shown in the disclosure of the Appendix incorporated herein by reference.

In addition to the aforementioned aspects and features of the present invention, it should be noted that the present invention further encompasses the various possible combinations and subcombinations of such aspects and features. Thus, for example, any aspect may be combined with a feature in accordance with the present invention without requiring any other aspect or feature.

Furthermore, other aspects and features of the invention includes the methods, apparatus, and operational logic of towel dispensers as disclosed in the above incorporated U.S. Patent Application Publications of the first paragraph, when combined and not inconsistent with the aspects and features explicitly discussed herein. Thus, for example, embodiments of the towel dispenser in accordance with one or more aspects and features of the present invention include towel dispensers that utilize the length learn logic for dispensing toweling as disclosed in one or more of the incorporated U.S. patent references.

BRIEF DESCRIPTION OF THE DRAWINGS

One or more preferred embodiments of the present invention are represented in the drawings.

DETAILED DESCRIPTION

Figure 1:
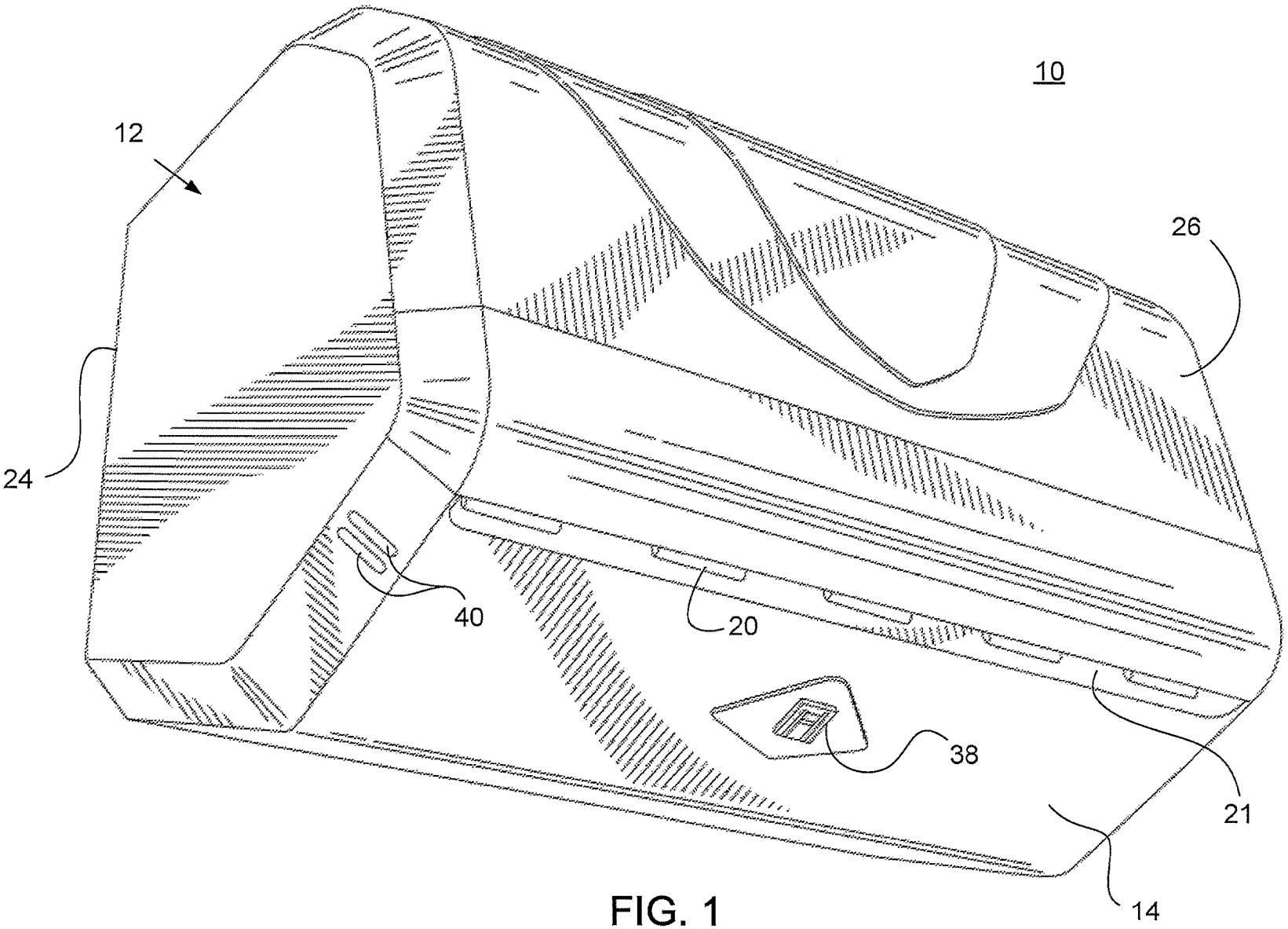
FIG. 1 is perspective view of an automatic paper towel dispenser apparatus in accordance with an embodiment of the invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the full scope of the present invention that is contemplated. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, embodiments of the present invention are next described. The following description of the embodiments is merely exemplary in nature and is in no way intended to limit the invention, its implementations, or uses.

FIG. 1 illustrates a perspective view of an automatic paper towel dispenser apparatus 10 in accordance an one embodiment of the present invention. The apparatus 10 preferably dispenses common perforated paper towels that are commercially readily available from grocery stores and other retail stores. Furthermore, the apparatus preferably has a learning capability, giving it the ability to detect and dispense towels of varying lengths, including full sheets, half sheets, multiple sheets, and abnormally sized sheets. Therefore, a wide variety of perforated towels can be used with the apparatus, including generally any brand or length available at retail.

Figure 3:
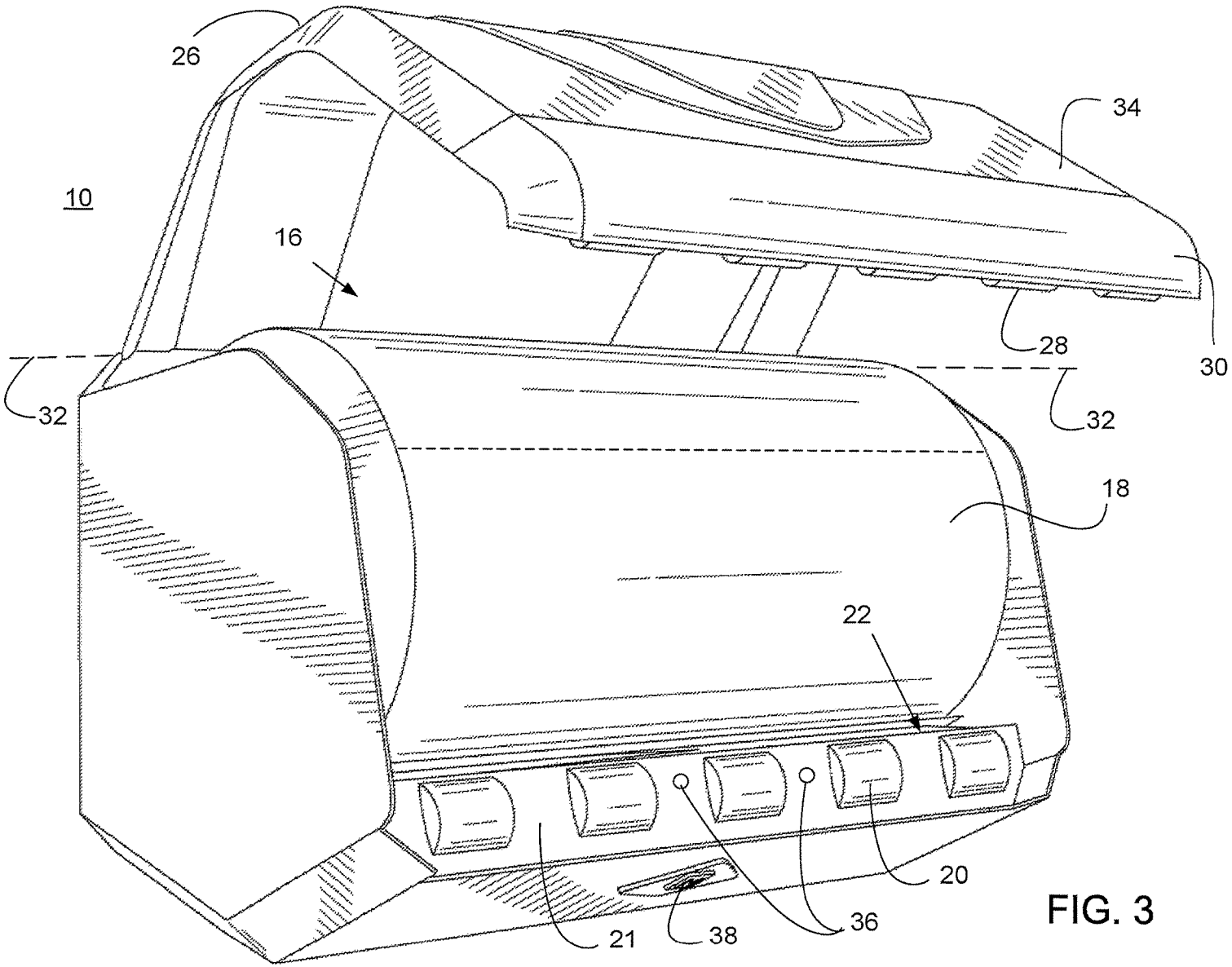
FIG. 3 is a perspective view of the automatic paper towel dispenser apparatus of FIG. 1, with the loading door in an open position, revealing toweling comprising a roll of perforated paper towels contained in an interior space of the dispenser housing.

With regard to FIGS. 1 and 3, the automatic paper towel dispenser apparatus 10 includes a housing 12 comprising a main body 14 defining an interior space 16 for receiving toweling comprising a roll of perforated towels 18. The housing 12 further includes one or more rollers 20 that extend along a front area 21 of the main body proximate an edge 22 of the interior space, and a motor assembly (not shown) for driving the one or more rollers.

The main body further includes a back wall 24 for mounting of the housing to a wall of a room, such as a tile wall of a restroom or kitchen of a residential or commercial establishment. The mounting mechanism is conventional and is not further described.

Preferably, the interior space 16 comprises a curved surface configured to receive the roll 18 of towels in loose or floating engagement therewith such that the roll 18 of towels rolls and slides on the curved surface of the interior space 16 during unwinding of the roll 18 of towels.

The automatic paper towel dispenser apparatus 10 also includes a loading door 26 that is configured to rotate relative to the main body, when the main body is mounted to a wall, between a closed position and an open position. Hinges (perhaps as best seen in Exhibit 6 of the Appendix) are preferably provided for pivoting movement of the loading door. The dispenser 10 is shown with the loading door 26 in the closed position in FIGS. 1 and 2, and with the loading door 26 in the open position in FIGS. 3 and 4.

The loading door 26 includes one or more rollers 28 extending along a section 30 of the loading door on the interior side thereof (perhaps best seen in FIG. 3). The section 30 extends along an end of the loading door 26 distally located to a pivot axis 32 of the hinges of the loading door 26 relative of the housing 12.

Figure 2:
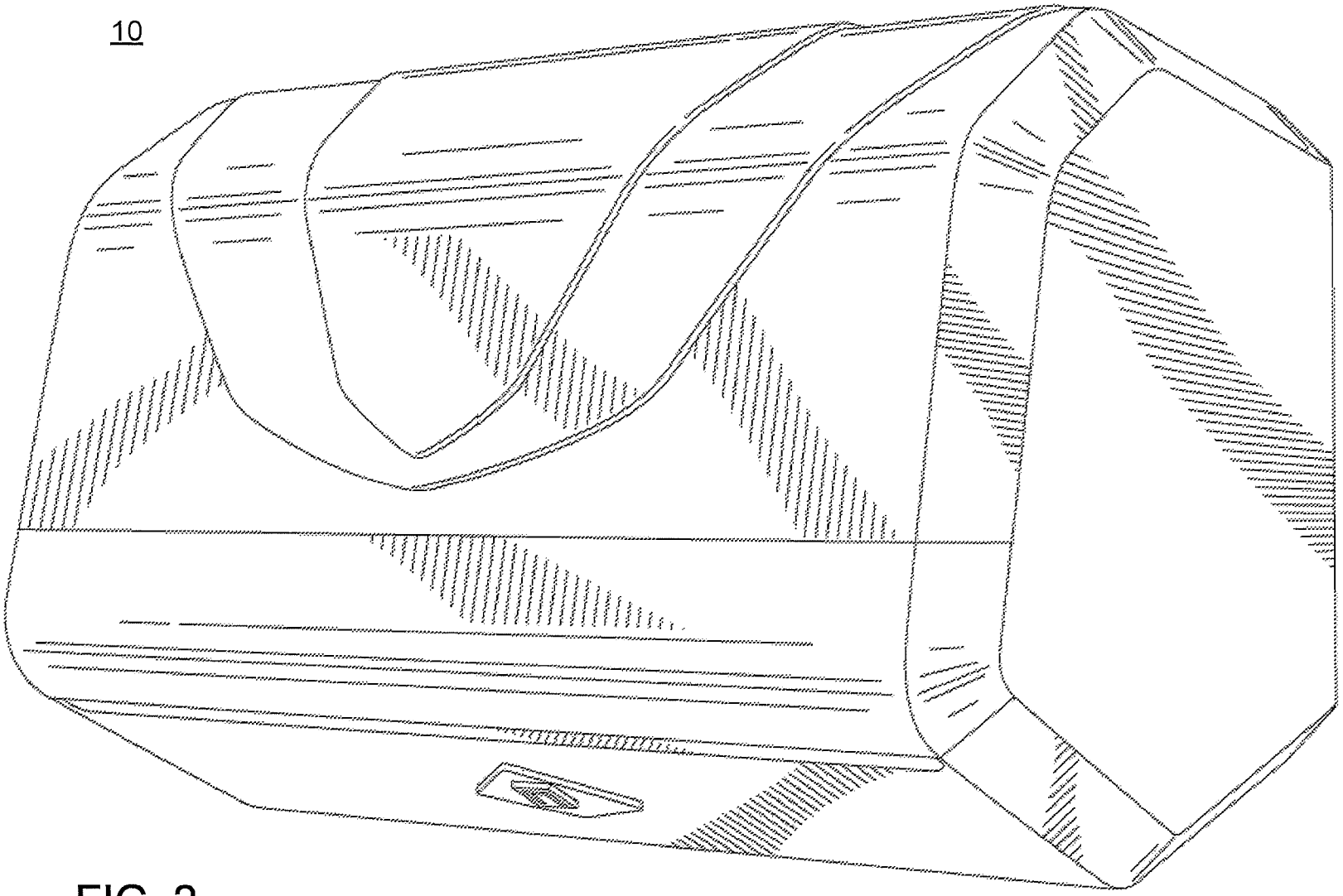
FIG. 2 is another perspective view of the automatic paper towel dispenser apparatus of FIG. 1.

When the loading door 26 is in the closed position, the one or more rollers 28 of the loading door 26 are driven by rotation of the one or more rollers 20 of the housing 12 when the one or more rollers 20 of the housing 12 are driven by the motor assembly. Furthermore; the loading door 26 and the housing 12 are configured to receive an extent of toweling between the loading door 26 and the housing 12 when the loading door 26 is in the closed position such that the extent of toweling is extended from the housing 12 for dispensing by driving of the rollers 20,28 of the housing 12 and loading door 26. Furthermore, as shown in FIGS. 1 and 2, when in the closed position, the loading door 26 extends over a top of and closes off the interior space of the main body 14 in which toweling is received.

Figure 4:
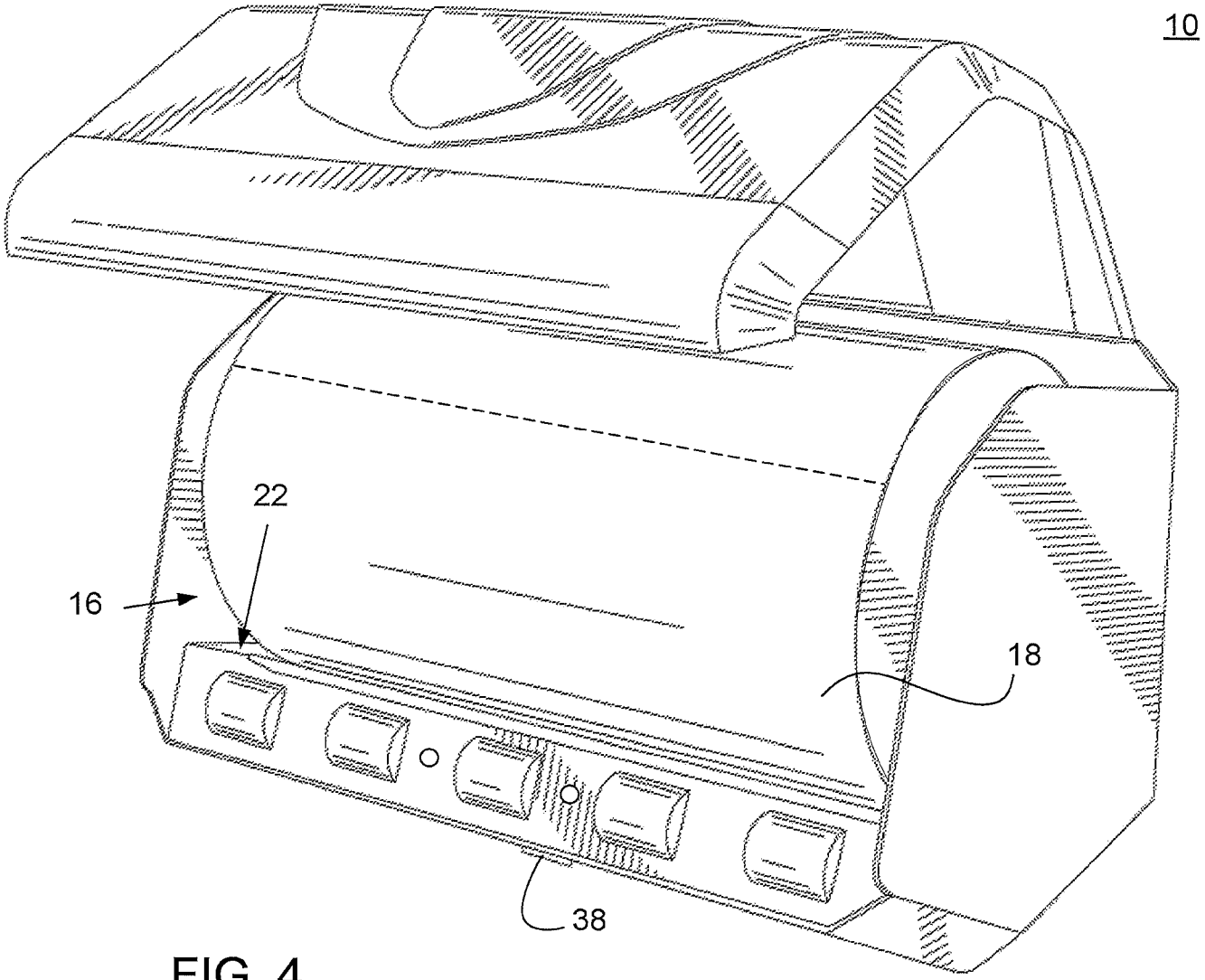
FIG. 4 is another perspective view of the automatic paper towel dispenser apparatus of FIG. 1, with the loading door in an open position, revealing toweling comprising a roll of perforated paper towels contained in an interior space of the dispenser housing.

When the loading door 26 is in the open position, the housing 12 is configured to receive toweling therein without obstruction by the loading door 26. In particular, an opening is defined by the housing 12 through which the toweling is inserted into the interior space of the main body 14 when the loading door 26 is in the open position, the opening extending across a top of the main body 14 and down a forward side of the main body 14 so as to expose approximately half of an exterior curved surface area of toweling (as shown in FIGS. 3 and 4) when received in the interior space when the loading door 26 is in the open position. Moreover, it will be appreciated that the loading door also extends downwardly and covers the opening along the forward side of the main body 14 when the loading door 26 is in the closed position, as shown in FIGS. 1 and 2.

In preferred embodiments, the loading door 26 is at least partially transparent. In this respect, a portion of the loading door 34 is transparent, but is not transparent along the section 30 of the one or more rollers 28 of the loading door 26, whereby the toweling within the interior space of the main body 14 is visible when the loading door 26 is in the closed position.

The dispenser also preferably includes one or more sensors 36 located on the main body 14 and configured to sense a leading edge of the toweling between a gap formed by the main body 14 and the loading door 26 when the loading door 26 is in the closed position.

The dispenser preferably further includes a sensor 38 located on a front exterior surface of the main body 14 for detecting motion and for causing the motor assembly to drive the rollers 20 directly or through a transmission when either motion or an object, such as a wave of a hand, or a hand itself, is detected by the sensor 38.

A light indicator 40 for indicating a status of the towel dispenser—such as an LED arrangement—also preferably is included in the apparatus 10.

Additional views of embodiments of wall mounted automatic paper towel dispenser apparatus in accordance with one or more aspects and features of the present invention are shown in the Appendix.

In this regard, Exhibit 1 of the Appendix is a perspective view of an automatic paper towel dispenser apparatus in accordance with an embodiment of the invention. As shown, the dispenser is mounted on the tile wall of a restroom of a commercial or residential establishment.

Exhibit 2 of the Appendix is another perspective view of the automatic paper towel dispenser apparatus of Exhibit 1 of the Appendix.

Exhibit 3 of the Appendix is a perspective view of the automatic paper towel dispenser apparatus of Exhibit 1 of the Appendix, with the loading door in an open position, revealing a roll of towels contained in an interior space of the dispenser housing.

Exhibit 4 of the Appendix is a perspective view of the automatic paper towel dispenser apparatus of Exhibit 1 of the Appendix, with the loading door in an open position, revealing a roll of towels contained in an interior space of the dispenser housing.

Exhibit 5 of the Appendix is yet another perspective view of the automatic paper towel dispenser apparatus of Exhibit 1 of the Appendix, with the loading door in an open position, revealing a roll of towels contained in an interior space of the dispenser housing.

Exhibit 6 of the Appendix is a schematic illustration of a top elevational view of the automatic paper towel dispenser apparatus of Exhibit 1 of the Appendix.

Exhibit 7 of the Appendix is a schematic illustration of a front elevational view of the automatic paper towel dispenser apparatus of Exhibit 1 of the Appendix.

Exhibit 8 of the Appendix is a schematic illustration of a side elevational view of the automatic paper towel dispenser apparatus of Exhibit 1 of the Appendix, wherein the rear back wall of the dispenser is parallel to the top edge of the sheet.

Exhibit 9 of the Appendix is another perspective view of the automatic paper towel dispenser apparatus of Exhibit 1 of the Appendix.

In further detail, Exhibit 1 of the Appendix is a perspective view of an automatic paper towel dispenser apparatus in accordance with an embodiment of the invention. As shown, the dispenser is mounted on a tile wall of a restroom or kitchen, for example, of a commercial establishment or residence.

Exhibit 2 of the Appendix is another perspective view of the automatic paper towel dispenser apparatus of Exhibit 1 of the Appendix; Exhibit 3 of the Appendix is a perspective view of the automatic paper towel dispenser apparatus of Exhibit 1 of the Appendix, with the loading door in an open position, revealing a roll of towels contained in an interior space of the dispenser housing; Exhibit 4 of the Appendix is a perspective view of the automatic paper towel dispenser apparatus of Exhibit 1 of the Appendix, with the loading door in an open position, revealing a roll of towels contained in an interior space of the dispenser housing; Exhibit 5 of the Appendix is yet another perspective view of the automatic paper towel dispenser apparatus of Exhibit 1 of the Appendix, with the loading door in an open position, revealing a roll of towels contained in an interior space of the dispenser housing; Exhibit 6 of the Appendix is a schematic illustration of a top elevational view of the automatic paper towel dispenser apparatus of Exhibit 1 of the Appendix; Exhibit 7 of the Appendix is a schematic illustration of a front elevational view of the automatic paper towel dispenser apparatus of Exhibit 1 of the Appendix; Exhibit 8 of the Appendix is a schematic illustration of a side elevational view of the automatic paper towel dispenser apparatus of Exhibit 1 of the Appendix, wherein the rear back wall of the dispenser is parallel to the top edge of the sheet; and Exhibit 9 of the Appendix is another perspective view of the automatic paper towel dispenser apparatus of Exhibit 1 of the Appendix.

Photographs of a working embodiment of a paper towel dispenser in accordance with one or more aspects and features of the present invention are shown in Exhibits 10 through 26 of the Appendix.

In this regard, Exhibit 10 shows a front elevational view of the paper towel dispenser; Exhibit 11 shows another front elevational view of the paper towel dispenser; Exhibit 12 shows a front perspective view of the front and top of the paper towel dispenser; Exhibit 13 shows a side perspective view of the front, top and left-hand side of the paper-towel dispenser; Exhibit 14 shows a side elevational view of the left-hand side of the paper towel dispenser; Exhibit 15 shows a side perspective view of the left-hand side, top and front of the paper towel dispenser; Exhibit 16 shows a side elevational view of the right-hand side of the paper towel dispenser; Exhibit 17 shows a side perspective view of the right-hand side, top and front of the paper towel dispenser; Exhibit 18 shows the top and front and front of the paper towel dispenser; Exhibit 19 shows a back of the paper towel dispenser, at which the towel dispenser is configured to be mounted to the surface of a wall via screws or bolts that extend through the openings shown in Exhibit 19; Exhibit 20 shows a perspective view of the bottom of the paper towel dispenser including a removable door for accessing a compartment that receives batteries for powering the paper towel dispenser, and that shows a port through which a power plug is received for alternatively powering the paper towel dispenser through a conventional electrical outlet; Exhibit 21 is a top perspective view with the loading door in the open position, whereby a perforated roll of paper towels may be placed within the paper towel roll receiving area of the dispenser; Exhibit 22 is another view of the paper towel dispenser with the loading door in the open position, and showing the paper towel dispenser mounted to a vertical wall via four screws extending through the openings in the rear wall of the dispenser; Exhibit 23 is another view of the paper towel dispenser with the loading door in the open position; Exhibit 24 is a view of an edge wall within the dispenser that bounds a side of the paper towel roll receiving area; Exhibit 25 is a perspective view of the paper towel dispenser following placement of the paper towel within the dispenser with the loading door closed; and Exhibit 26 is a perspective view of the dispenser of Exhibit 26 after the loading door has been closed.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested herein, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A sheet material dispenser comprising:

a housing comprising:

a main body, wherein the main body comprises an interior surface with respect to the housing;

a loading door movable between a closed position and an open position relative to the main body, wherein the loading door comprises an interior surface with respect to the housing; and a cavity formed between the loading door and the main body, wherein the cavity is sized to house a roll of sheet material therein;

a main body roller positioned on a portion of the interior surface of the main body, wherein the main body roller is mounted within the main body in a recessed manner with respect to the portion of the interior surface such that only a portion of the main body roller is visible; and a loading door roller positioned on a portion of the interior surface of the loading door, wherein the loading door roller is mounted within the loading door in a recessed manner with respect to the portion of the interior surface such that only a portion of the loading door roller is visible, wherein the loading door roller and the main body roller are positioned within the housing so as to be hidden from a user when the loading door is in the closed position, wherein the loading door roller is visible to the user when the loading door is in the open position, wherein, when the loading door is in the open position, the loading door roller is spaced apart from the main body roller and an opening is formed, wherein the opening is sized to enable the user to insert the roll of sheet material into the cavity.

2. The sheet material dispenser of claim 1, wherein the opening is sized to enable the user to position a leading portion of the roll of sheet material between the spaced apart loading door roller and main body roller, wherein, in an instance in which the roll of sheet material is within the cavity and the leading portion of the roll of sheet material is positioned between the loading door roller and the main body roller, movement of the loading door to the closed position causes the roll of sheet material to be installed in the sheet material dispenser and ready for dispensing with the leading portion of the roll of sheet material sandwiched between the loading door roller and the main body roller.

3. The sheet material dispenser of claim 1, wherein, when installed in the cavity, the roll of sheet material is not fixed relative to an axis of the housing during dispensing.

4. The sheet material dispenser of claim 1, wherein the opening formed when the loading door is in the open position is sized to enable the user to drop the roll of sheet material into the cavity.

5. The sheet material dispenser of claim 1, wherein the cavity defines an internal curved surface that corresponds to curvature of an outer circumference of the roll of sheet material.

6. The sheet material dispenser of claim 5, wherein the cavity is further defined by opposing side walls that correspond to a top and a bottom of the roll of sheet material.

7. The sheet material dispenser of claim 6, wherein the main body comprises the opposing side walls and the internal curved surface of the cavity.

8. The sheet material dispenser of claim 1, wherein the main body defines a back portion that is configured to enable mounting to a wall.

9. The sheet material dispenser of claim 8, wherein the loading door is configured to rotate upwardly away from the main body when moved from the closed position to the open position.

10. The sheet material dispenser of claim 1 further comprising a motor configured to operate the main body roller to cause dispensing of the roll of sheet material from the sheet material dispenser.

11. The sheet material dispenser of claim 10 further comprising a proximity sensor that is configured to sense an object and, in response, generate a signal to cause the motor to operate to cause dispensing of the roll of sheet material.

12. The sheet material dispenser of claim 10 further comprising a leading edge sensor that is positioned proximate the main body roller and configured to sense a leading edge of the roll of sheet material and, in response, generate a signal to cause the motor to cease operation.

13. The sheet material dispenser of claim 12 further comprising a controller that is configured to detect and dispense sheets of varying lengths from an installed roll of sheet material.

14. A sheet material dispenser comprising:

a body comprising an interior surface;

a loading door attached to the body and movable between a closed position and an open position relative to the body, wherein the loading door comprises an interior surface, wherein a cavity is formed between the loading door and the body, wherein the cavity is sized to hold a roll of sheet material in loose engagement therein; and a loading door roller positioned on a portion of the interior surface of the loading door, wherein the loading door roller is mounted within the loading door in a recessed manner with respect to the portion of the interior surface such that only a portion of the loading door roller is visible, wherein, in an instance in which the loading door is in the closed position, the loading door roller is hidden from a user, wherein, in an instance in which the loading door is in the open position, the loading door roller is visible to the user, wherein, in an instance in which the loading door is in the open position, the body is spaced apart from the loading door roller and an opening is formed therebetween, wherein the opening is sized to enable the user to insert the roll of sheet material into the cavity.

15. The sheet material dispenser of claim 14, wherein, when installed in the cavity, the roll of sheet material is not fixed relative to an axis of the body during dispensing.

16. The sheet material dispenser of claim 14, wherein the opening formed when the loading door is in the open position is sized to enable the user to drop the roll of sheet material into the cavity.

17. The sheet material dispenser of claim 14, wherein the cavity defines an internal curved surface that corresponds to curvature of an outer circumference of the roll of sheet material.

18. A sheet material dispenser comprising:

a body comprising an interior surface;

a loading door attached to the body and movable between a closed position and an open position relative to the body, wherein the loading door comprises an interior surface, wherein a cavity is formed between the loading door and the body, wherein the cavity is sized to hold a roll of sheet material in loose engagement therein; and a body roller positioned on a portion of the interior surface of the body, wherein the body roller is mounted within the body in a recessed manner with respect to the portion of the interior surface such that only a portion of the body roller is visible, wherein, in an instance in which the loading door is in the closed position, the body roller is hidden from a user, wherein, in an instance in which the loading door is in the open position, the body roller is visible to the user, wherein, in an instance in which the loading door is in the open position, the loading door is spaced apart from the body roller and an opening is formed therebetween, wherein the opening is sized to enable the user to insert the roll of sheet material into the cavity.

19. The sheet material dispenser of claim 18, wherein, when installed in the cavity, the roll of sheet material is not fixed relative to the body during dispensing.

20. The sheet material dispenser of claim 18 further comprising a motor configured to operate the body roller to cause the leading portion of the roll of sheet material to dispense from the sheet material dispenser.

* * * * *